US005940895A

United States Patent [19]

Wilson et al.

[11] Patent Number: 5,940,895

[45] Date of Patent: Aug. 24, 1999

[54] HEATED TOILET SEAT

[75] Inventors: David S. Wilson, Sheboygan; David E. Hansen, Howards Grove; Anton J. Kolar; Michael J. Merritt, both of Sheboygan; John Check, Manitowoc, all of Wis.

[73] Assignee: Kohler Co., Kohler, Wis.

[21] Appl. No.: 09/061,458

[22] Filed: Apr. 16, 1998

[51] Int. Cl.[6] ..... A47K 13/00

[52] U.S. Cl. ..... 4/237; 4/DIG. 6

[58] Field of Search ..... 4/237, 238, 239, 4/DIG. 6

[56] References Cited

U.S. PATENT DOCUMENTS

| | | | |
|---|---|---|---|
| 1,689,386 | 10/1928 | Hawkins . | |
| 2,447,738 | 8/1948 | Conner . | |
| 2,493,362 | 1/1950 | Rocker . | |
| 2,540,620 | 2/1951 | Hyde . | |
| 2,593,087 | 4/1952 | Baggett | 4/DIG. 6 |
| 2,972,034 | 2/1961 | Easley . | |
| 3,069,522 | 12/1962 | Jamison . | |
| 3,073,937 | 1/1963 | Easley . | |
| 3,493,721 | 2/1970 | Kamitani et al. . | |
| 4,422,190 | 12/1983 | Huang . | |
| 4,446,584 | 5/1984 | Suzuki et al. . | |
| 4,850,060 | 7/1989 | Kou . | |
| 5,095,555 | 3/1992 | Torii et al. . | |
| 5,586,214 | 12/1996 | Eckman . | |

*Primary Examiner*—David J. Walczak
*Attorney, Agent, or Firm*—Quarles & Brady LLP

[57] ABSTRACT

A heated toilet seat with an outer clam shell type housing and an inner clam shell type housing. A heater wire is positioned in the inner housing to distribute heat. The inner housing is held above the bottom portion of the seat so that little heat is wasted by passing down through the bottom portion. The inner housing can be of essentially the same geometric configuration as the top and bottom portions of the outer housing, and groove and rib structures can tightly enclose the wiring in the inner housing.

5 Claims, 5 Drawing Sheets

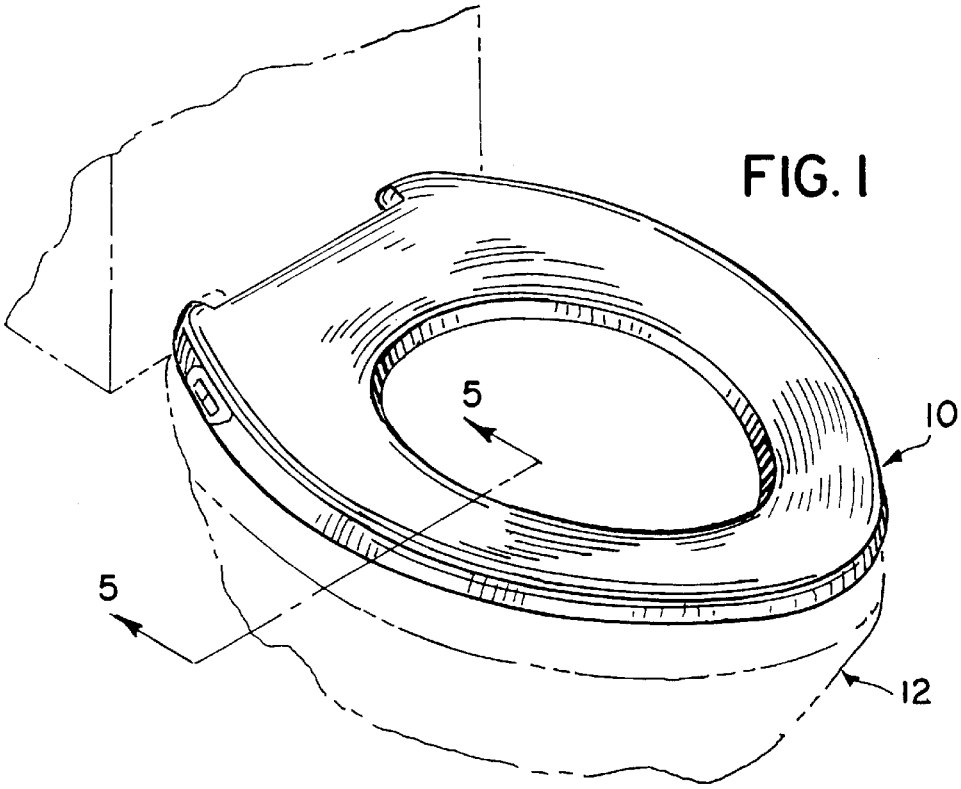
FIG. 1
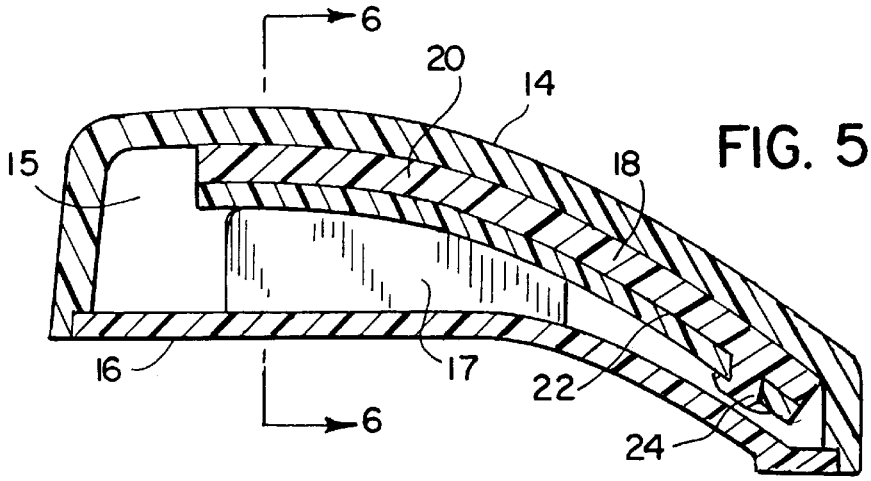
FIG. 5
FIG. 6
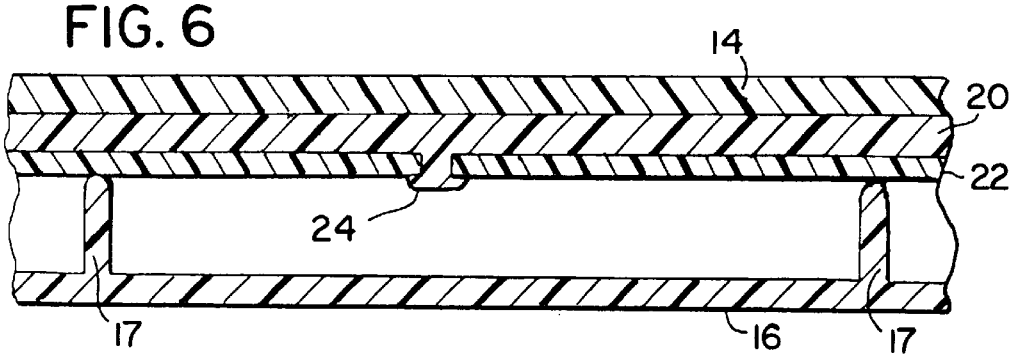

HEATED TOILET SEAT

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

The present invention relates to plumbing fixtures such as toilets, and more particularly to heated toilet seats.

A number of types of heated toilet seats are known. For example in U.S. Pat. No. 3,073,937 a single strand of heating wire is aligned with the configuration of the seat. The heating wire is placed in a downwardly open groove which is then filled with a heat resistant material. Among other things, this seat has uneven heat distribution, as well as aesthetic problems.

U.S. Pat. No. 3,493,721 discloses a toilet seat that provides somewhat better distribution of heat. A pair of heating elements are placed between upper and lower portions of a toilet seat. However, this system places the heating elements in direct contact with the bottom portion of the seat (where heat loss can occur).

Other known heated toilet seats are deficient in other respects. For example, some are not aesthetically pleasing in external design. Others are difficult to manufacture and/or require the outer seat to be an expensive, specialized material.

It can therefore be seen that a need exists for an improved heated toilet seat.

BRIEF SUMMARY OF THE INVENTION

In one embodiment the invention provides a heated toilet seat with an outer housing in the form of a toilet seat which has a hollow cavity therein. An inner heater housing is positioned in the hollow cavity and is supported therein by ribs extending up from a bottom wall of the outer housing.

A heating wire is enclosed in the inner heater housing, and means extend through the outer housing for connecting the heating wire to a supply of electricity. The inner heater housing is comprised of an upper portion and a lower portion. The lower portion has grooves therein for retaining the heating wire.

In one form, the inner heater housing grooves extend radially with respect to the seat and projecting members extend down from the upper portion of the inner housing in contact with the heating coil wire. This provides more uniform heat transfer from the wire (because it is tightly enclosed by the projections and grooves).

In yet another aspect the inner housing and at least the top portion of the outer housing are composed of a thermoconducting plastic (preferably two different thermoconducting plastics).

The objects of the invention include providing a heated toilet seat of the above kind:

(a) having more uniform heat distribution;

(b) which reduces heat loss through the lower portion of the seat;

(c) which protects the heater wiring from contact with water;

(e) which has a pleasing aesthetic appearance; and (e) which has a durable construction.

These and still other objects and advantages of the invention will be apparent from the description which follows. In the detailed description below a preferred embodiment of the invention will be described with reference to the accompanying drawings. This embodiment does not represent the full scope of the invention. Rather the invention may be employed in other embodiments. Reference should therefore be made to the claims herein for interpreting the full breadth of the invention.

BRIEF DESCRIPTION OF THE DRAWINGS

FIG. 1 is a top perspective view showing a heated toilet seat of this invention (which has been positioned on a conventional toilet);

FIG. 5 is a sectional view taken along line 5—5 of FIG. 1;

FIG. 6 is a sectional view taken along line 6—6 of FIG. 5;

DETAILED DESCRIPTION OF THE INVENTION

Figure 2:
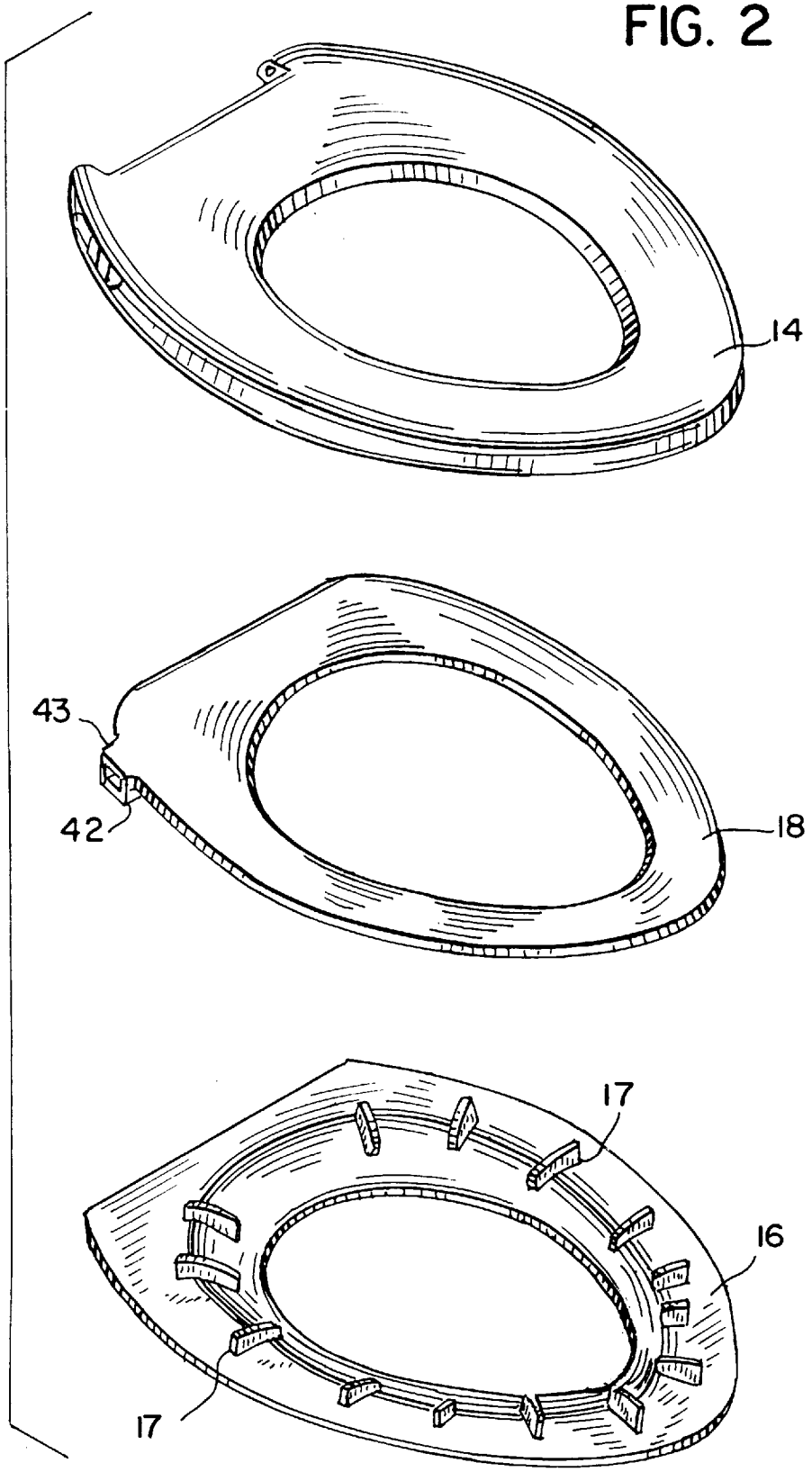
FIG. 2 is an exploded view of the seat.
Figure 3:
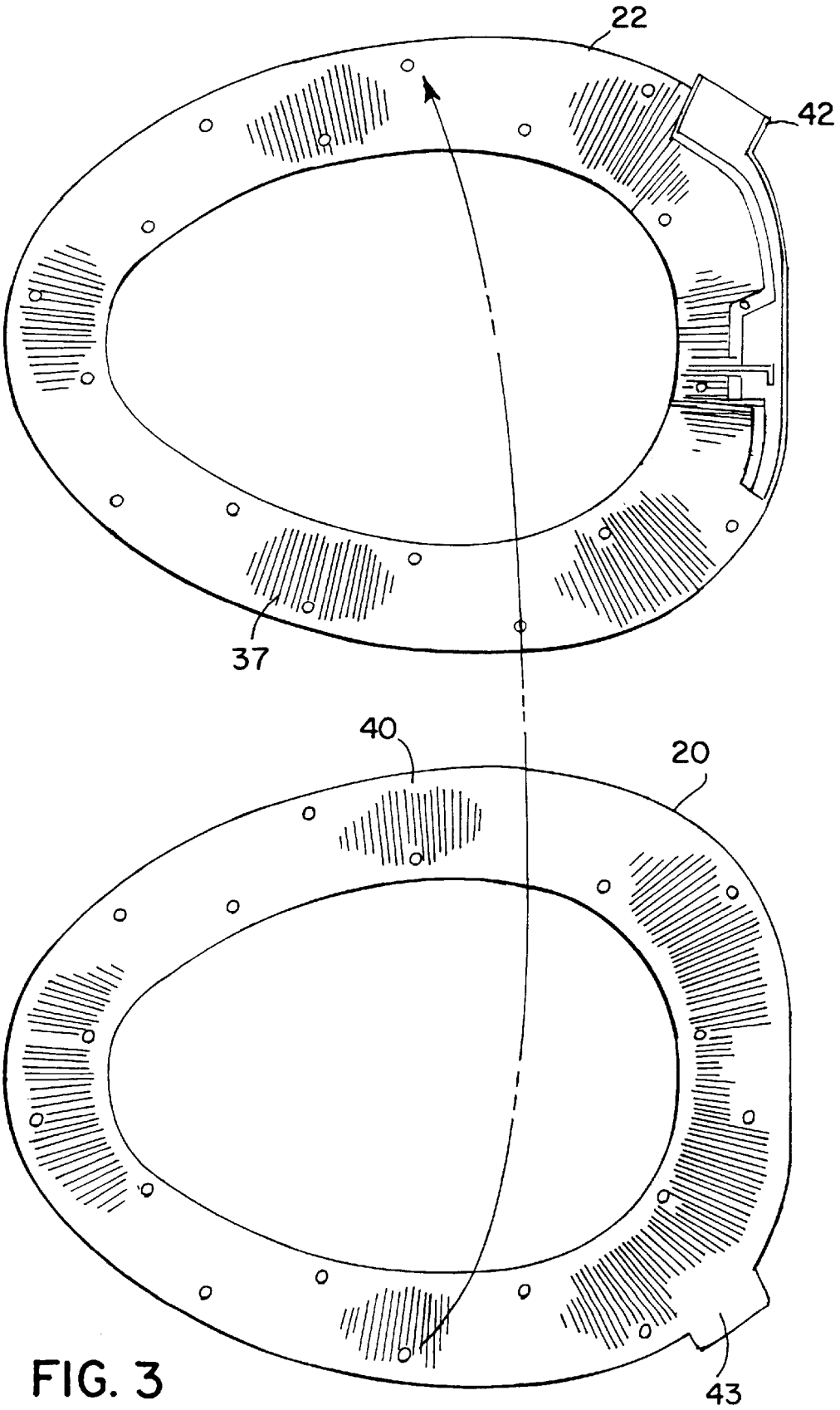
FIG. 3 is an exploded view of an inner heater housing.

Referring specifically to FIGS. 1–3, a heated toilet seat 10 is shown in conjunction with a conventional toilet 12. The seat 10 has an outer two part housing comprised of a top portion 14 and a bottom portion 16. There is a hollow cavity 15 therebetween. While not shown, it will be appreciated that the outer housing is formed with rear holes to accept the usual rear hinge pins or the like so that the housing can be assembled in the usual fashion to a toilet.

Two part inner heater housing 18 is positioned in the cavity and composed of an upper portion 20 and a lower portion 22. It is housed between the top portion 14 and bottom portion 16. This is seen in FIGS. 5 and 6. Note especially upstanding ribs 17 extending up from the bottom portion 16 for supporting the inner heater housing 18 above the bottom portion 16.

With specific reference to FIGS. 4 and 7–9, it can be seen that heater wire coil 26 is placed on the lower portion 22 of the inner heater housing 18. It extends from side to side in a radial manner (with respect to the seat's central hole) and is tightly housed in grooves 37 in the lower portion 22. Ribs extend down from the upper portion 20 to retain the wire coil in the passages in a tight surrounding enclosure.

Figure 4:
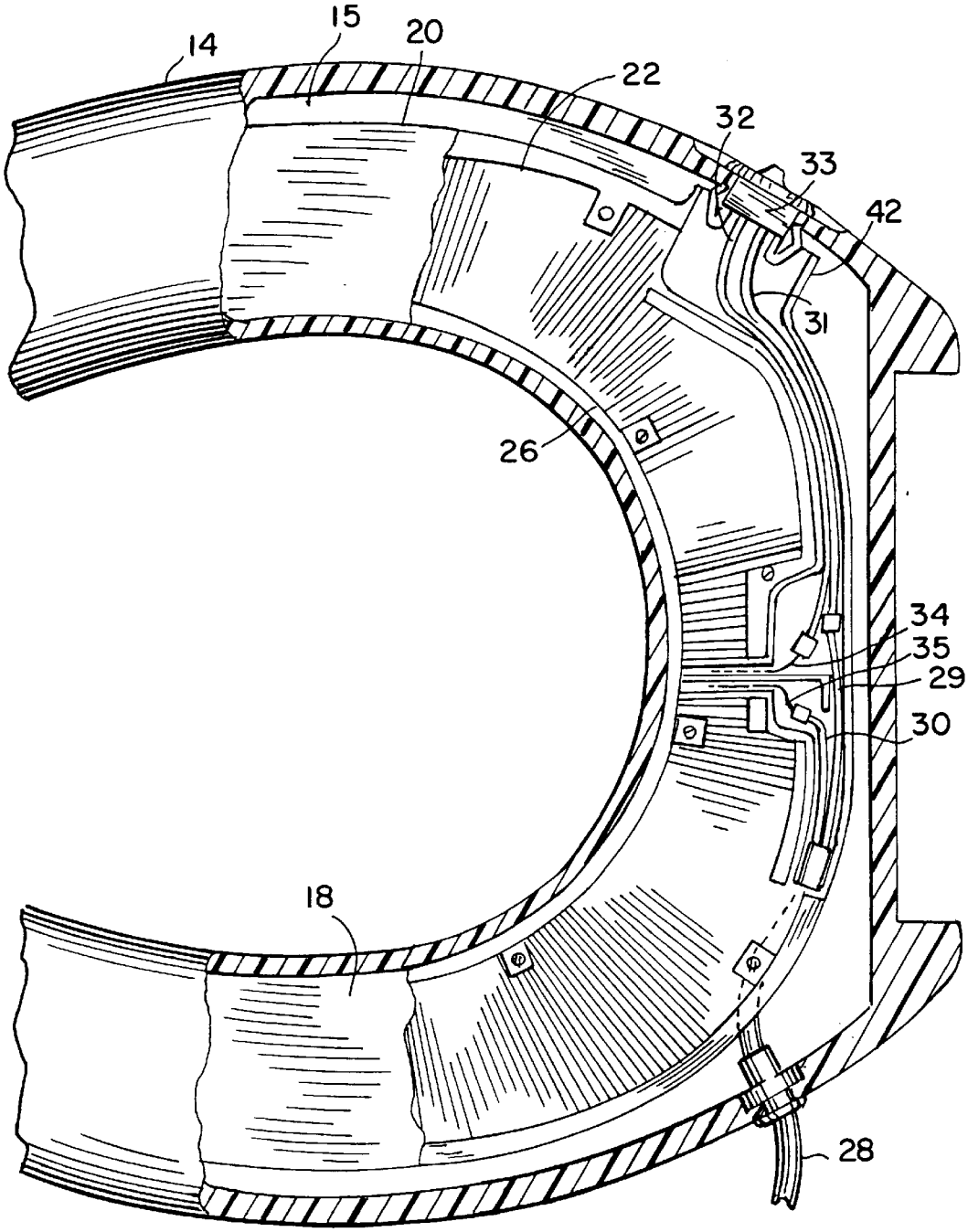
FIG. 4 is a top plan view of the heated toilet seat, with portions broken away.
Figure 7:
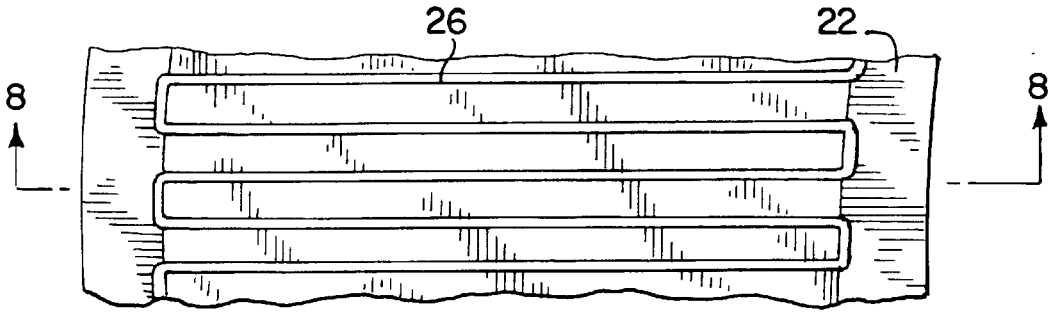
FIG. 7 is an enlarged detailed view showing a layout of the heater wiring of the heated toilet seat.
Figure 8:
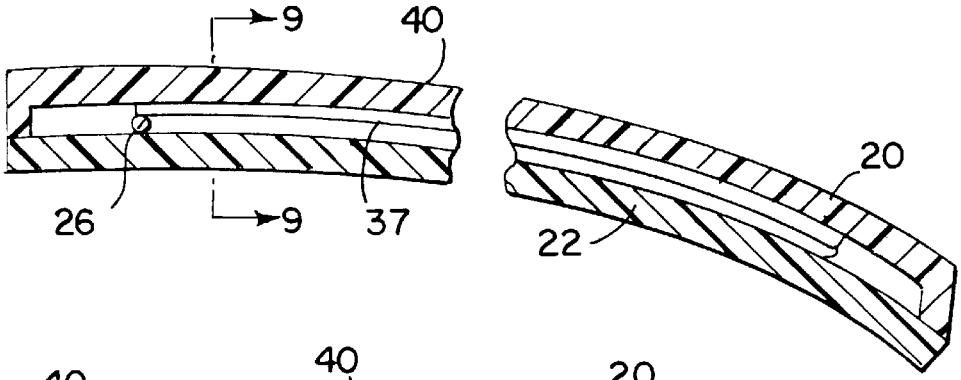
FIG. 8 is a sectional view taken along line 8—8 of FIG. 7, but with the top of the inner heater unit assembled therewith.
Figure 9:
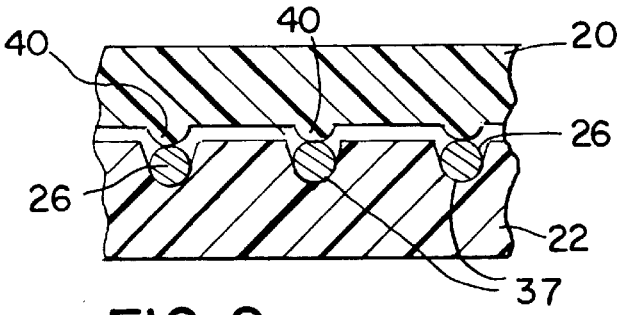
FIG. 9 is a sectional view taken along 9—9 of FIG. 8.

Referring specifically to FIG. 4, incoming current is supplied by wire 28 which houses wire 29 connected to a conventional switch 33 by the wire 31. Wire 31 is interconnected to wire end 34 of the coil wire by the wire 32.

The other lead in wire 30 is connected to the other wire end 35 of the wire coil 26. Suitable compartments 42 and 43 are formed in the upper and lower portions 20 and 22 of the seat to accommodate the switch 33. These are also illustrated in FIG. 3.

Referring back to FIGS. 5 and 6, the upper and lower portions 20 and 22 of the inner heater housing 18 are snap interconnected by the friction rivets 24. The top portion 14, as well as the upper and lower portions 20 and 22 of the heater housing 18, are composed of highly thermoconductive plastic materials.

The outer housing parts 14 and 16 can be a conventional, relatively inexpensive plastic that is conventionally used to form toilet seats, such as polypropylene. The inner housing can be a temperature resistant (yet still high heat conductive) plastic such as polyphenylene sulfide which is sold under the trade name Fortron PPS. The top portion 14 can be connected to the bottom portion 16 by vibration welding or other conventional means.

An important feature of the heated toilet seat 10 is the relatively uniform distribution of heat to the outer upper surface of top portion 14. This is in part effected by the wire coil 26 extending around the seat, to the radial alignment of the wire, and to the tight enclosure that the wire is held in.

Another important feature is that the inner housing is held above the bottom portion 16 by the ribs 17. The air space below inner housing 18 provides insulation between it and the bottom portion 16. As such, heat loss through the bottom portion 16 is reduced. Also, in the event of water leakage into the outer housing, the water will tend to stay away from the wire.

Note also that because standard plastics that have been used for toilet seats can still be used for the outer housing, heated versions of such seats can be made without affecting the exterior ornamental appearance of most of the outer seat. Thus, a consumer is able to substitute the seat for an existing non-heated one of the same style.

While a specific embodiment has been shown, other modifications of the heated toilet seat can be made. For example, while a specific oval seat and inner heater unit are shown, other geometric configurations (such as an open U seat and U shaped inner housing) could be employed. Further, while specific plastic materials have been described, other thermoconductive plastics could also be employed.

Also, while an internal switch 33 has been provided for use with the preferred heated toilet seat 10, the switch could be separately mounted on the toilet, or be at the point of connection to the electric supply.

Industrial Applicability

The invention is useful in providing a toilet seat that can be heated.

We claim:

1. A heated toilet seat, comprising:

an outer housing in the form of a toilet seat which has a hollow cavity;

a two component inner heater housing having opposing portions positioned in the hollow cavity and supported therein by ribs extending up from a bottom wall of the outer housing;

a heating wire essentially enclosed in the inner heater housing; and means extending through the outer housing for connecting the heating wire to a supply of electricity.

2. The heated toilet seat as defined in claim 1, wherein the inner heater housing is comprised of an upper portion and a lower portion, the lower portion having grooves therein for retaining the heating wire.

3. The heated toilet seat as defined in claim 2, wherein the grooves are defined by channels extending essentially radially with respect to a central hole in the seat.

4. A heated toilet seat, comprising:

an outer housing in the form of a toilet seat which has a hollow cavity;

an inner heater housing positioned in the hollow cavity and supported therein by ribs extending up from a bottom wall of the outer housing;

a heating wire essentially enclosed in the inner heater housing;

the inner heater housing comprised of an upper portion and a lower portion, the lower portion having grooves therein for retaining the heating wire;

means extending through the outer housing for connecting the heating wire to a supply of electricity; and projecting members extending down from the upper portion in contact with the heating coil wire.

5. The heated toilet seat as defined in claim 1, wherein the inner heater housing and the top portion of the toilet seat are composed of two different thermoconducting plastics.

* * * * *